US008710771B2

(12) United States Patent
Reams

(10) Patent No.: US 8,710,771 B2
(45) Date of Patent: Apr. 29, 2014

(54) DUTY CYCLE ADJUSTMENT OF REMOTE ILLUMINATION SOURCE TO MAINTAIN ILLUMINATION OUTPUT

(75) Inventor: William R. Reams, Englewood, CO (US)

(73) Assignee: EchoStar Technologies L.L.C., Englewood, CO (US)

( * ) Notice: Subject to any disclaimer, the term of this patent is extended or adjusted under 35 U.S.C. 154(b) by 347 days.

(21) Appl. No.: 13/288,788

(22) Filed: Nov. 3, 2011

(65) Prior Publication Data

US 2013/0113388 A1 May 9, 2013

(51) Int. Cl.
*H05B 37/02* (2006.01)

(52) U.S. Cl.
USPC ..... 315/307; 315/295

(58) Field of Classification Search
USPC ..... 315/246, 250, 294, 295, 307, 291, 308
See application file for complete search history.

(56) References Cited

U.S. PATENT DOCUMENTS

| | | | | |
|---|---|---|---|---|
| 8,013,537 | B2 * | 9/2011 | Summerland | 315/291 |
| 2011/0279040 | A1 * | 11/2011 | Briggs et al. | 315/136 |
| 2012/0062133 | A1 * | 3/2012 | Cubias | 315/201 |

* cited by examiner

*Primary Examiner* — David H Vu
(74) *Attorney, Agent, or Firm* — Seed IP Law Group

(57) ABSTRACT

A remote directs illumination of an illumination source according to a duty cycle. The duty cycle defines a first portion of time power is provided from a battery and a second portion of time power is not provided. The remote monitors voltage output by the battery and adjusts the duty cycle to increase the duration of the first portion based on a decrease of the monitored voltage compared to a maximum voltage level. The remote may adjust the duty cycle in order to maintain a consistent illumination output level. In some implementations, the remote may adjust the duty cycle based on one or more threshold values. In other implementations, the remote may adjust the duty cycle directly based on the measured voltage. In still other implementations, the remote may not calculate the duty cycle directly but may instead reference a lookup table.

20 Claims, 4 Drawing Sheets

DUTY CYCLE ADJUSTMENT OF REMOTE ILLUMINATION SOURCE TO MAINTAIN ILLUMINATION OUTPUT

FIELD OF THE INVENTION

This disclosure relates generally to remote control devices, and more specifically to maintaining illumination output for remote control illumination sources by adjusting the duty cycle of the illumination source based on battery voltage.

SUMMARY

The present disclosure discloses systems and methods for adjusting duty cycles of remote control illumination sources. A remote control may direct illumination of one or more illumination sources of the remote control according to one or more duty cycles. The duty cycle may define a first portion of time that power is provided to the illumination source from one or more batteries to illuminate the illumination source and a second portion of time that power is not provided to the illumination source from the battery. The remote control may monitor the voltage output by the battery and may adjust the duty cycle to increase the duration of the first portion of time (and correspondingly decrease the second portion of time) based on a decrease of the monitored voltage compared to a maximum voltage level of the battery.

In various implementations, the remote control may adjust the duty cycle based on the monitored voltage in order to maintain a consistent illumination output level output by the illumination source regardless of decreasing voltage levels output by the battery as the capacity of the battery decreases. Such illumination sources may include one or more light emitting diodes (LEDs), infrared (IR) light emitting diodes (IREDs), OLEDs (organic light emitting diodes), incandescent bulbs, fluorescent bulbs, and/or any other illumination source that may be utilized by the remote control device and/or may be utilized that may be utilized as one or more illumination transmitters, one or more lighting elements, and/or any other functional element for which a remote control device may utilize an illumination source.

In some implementations, the remote control may adjust the duty cycle based on one or more threshold values related to the measured voltage. As such, the duty cycle may be adjusted when the measured voltage crosses the one or more threshold values. In other implementations, the remote control may adjust the duty cycle directly based on the measured voltage. As such, the duty cycle may be adjusted whenever the measured voltage changes.

In still other implementations, the remote control may not calculate the duty cycle directly but may instead reference a lookup table utilizing the measure voltage to obtain the duration which the remote control may then utilize. Such a lookup table may include one or more entries of corresponding duty cycle durations and measured voltages.

It is to be understood that both the foregoing general description and the following detailed description are for purposes of example and explanation and do not necessarily limit the present disclosure. The accompanying drawings, which are incorporated in and constitute a part of the specification, illustrate subject matter of the disclosure. Together, the descriptions and the drawings serve to explain the principles of the disclosure.

DETAILED DESCRIPTION OF THE EMBODIMENTS

Figure 1:
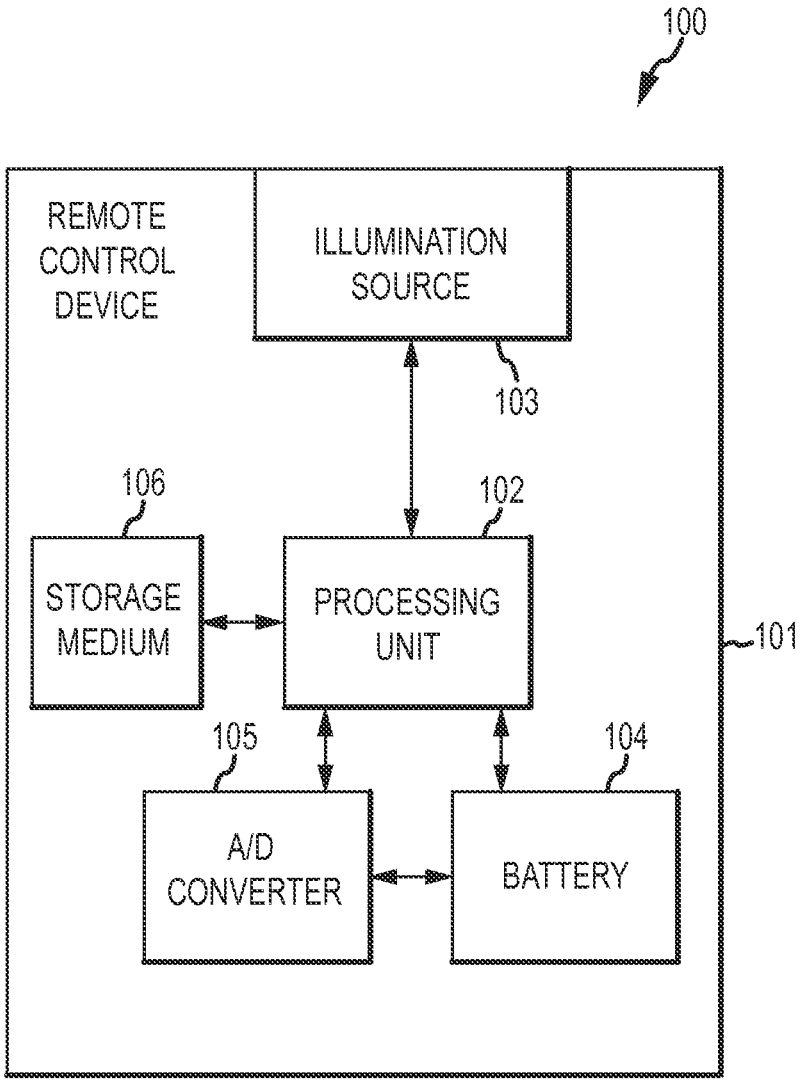
FIG. 1 is a block diagram illustrating a system for adjusting duty cycles of remote control illumination sources.

The description that follows includes sample systems, methods, and computer program products that embody various elements of the present disclosure. However, it should be understood that the described disclosure may be practiced in a variety of forms in addition to those described herein.

Remote control devices may be utilized to control a variety of different electronic devices such as television receivers, digital music players, televisions, set top boxes, digital video recorders, video cassette recorders, desktop computers, laptop computers, cellular telephones, smart phones, mobile computers, entertainment systems, stereo systems, electronic kitchen appliances, environmental control systems, security systems, and/or any other kind of electronic device. In various implementations, the remote control devices may include one or more illumination sources. Such illumination sources may include one or more LEDs and/or IREDs that may be utilized as one or more illumination transmitters (such as one or more IR light transmitters), one or more lighting elements (such as one or more backlighting elements that provide backlighting for one or more buttons and/or other selection elements), and/or any other illumination source that may be utilized by the remote control device. Further, such illumination sources may be illuminated utilizing power provided by one or more batteries.

Illuminating such illumination sources may be one of the most power consumptive operations performed by such remote control devices. As such, illumination of such illumination sources may drain available power from the batteries. Further, as illumination of such illumination sources may be powered utilizing power provided from the batteries, the power provided may not always be uniform. Batteries may provide a maximum voltage level when the batteries are at full capacity and may provide less and less voltage as the capacity of the battery is depleted. This non-uniform power provided by the batteries may result in inconsistent illumination levels over time. This may often be most noticeable to the average remote control user as he or she must more carefully aim the remote control at the controlled device when the battery voltage drops near end of life.

In some cases, various remote control devices may illuminate illumination sources according to one or more duty cycles in order to attempt to consume less power. As such, instead of constantly illuminating the illumination sources when the illumination sources are to be illuminated, the illumination sources may be illuminated for one or more first portions of a period of time and not illuminated for one or more second portions of the period of time. The duty cycle (i.e., the combination of the first and second portions of the period of time) may vary between the first and second portions such that the illumination source is perceived (such as by one or more users and/or illumination receiver elements) to be consistently illuminated despite the second portions of the duty cycle.

However, though such duty cycles may reduce power consumed in illuminating remote control device illumination sources, non-uniform levels of power provided by the batteries may still result in uneven illumination levels over time. When the illumination sources are utilized as lighting elements for a remote control device, such inconsistent illumination levels may result in lighting that is inadequate and/or at noticeably different levels to a user of the remote control device. Further, when the illumination sources are utilized as illumination transmitters for a remote control device, such inconsistent illumination levels may result in one or more intended receivers not receiving one or more transmitted messages.

The present disclosure discloses systems and methods for adjusting duty cycles of remote control illumination sources. A remote control may direct illumination of one or more illumination sources of the remote control according to one or more duty cycles. The duty cycle may define a first portion of time that power is provided to the illumination source from one or more batteries to illuminate the illumination source and a second portion of time that power is not provided to the illumination source from the battery. The remote control may monitor the voltage output by the battery and may adjust the duty cycle to increase the duration of the first portion of time (i.e. "on" time) based on a decrease of the monitored voltage compared to a maximum voltage level of the battery. In this way, as the "on" portion of the duty cycle is increased as the voltage output by the battery decreases, a consistent illumination output level output by the illumination source may be maintained. As a result, when the illumination sources are utilized as lighting elements for a remote control device, users may not perceive inadequate and/or at noticeably different levels illumination levels. Further, when the illumination sources are utilized as illumination transmitters for a remote control device, intended receivers may still be able to receive transmitted messages.

FIG. 1 is a block diagram illustrating a system 100 for adjusting duty cycles of remote control illumination sources. The system 100 includes a remote control device 101. The remote control device may include one or more processing units 102, one or more illumination sources 103, one or more batteries 104, one or more analog to digital converters, and/or one or more non-transitory storage media 106 (which may take the form of, but is not limited to, a magnetic storage medium; optical storage medium; magneto-optical storage medium; read only memory; random access memory; erasable programmable memory; flash memory; and so on). The illumination source may be one or more LEDs, IREDs, OLEDs, incandescent bulbs, fluorescent bulbs, and/or any other device capable of illumination. The battery (which may include two or more cells) may be any kind of battery such as one or more alkaline batteries, zinc-carbon batteries, lead-acid batteries, nickel-cadmium batteries, nickel-zinc batteries, nickel metal hydride batteries, lithium-ion batteries, and/or any other kind of component that converts stored chemical energy into electrical energy. Additionally, future batteries may utilize as yet undeveloped fuel cell technologies.

The processing unit 102 may execute one or more instructions stored in the non-transitory storage medium 106 in order to communicate with and/or control one or more electronic devices (such as one or more television receivers, digital music players, televisions, set top boxes, digital video recorders, video cassette recorders, desktop computers, laptop computers, cellular telephones, smart phones, mobile computers, entertainment systems, stereo systems, electronic kitchen appliances, environmental control systems, security systems, and/or any other kind of electronic device). The processing unit may perform such operations in response to input received via one or more user interface components (not shown) such as one or more buttons, keys, touch pads, and/or any other component for communicating with one or more users.

Further, the processing unit 102 may execute one or more instructions stored in the non-transitory storage medium 106 in order to direct illumination of the illumination source 103 according to one or more duty cycles. The processing unit may direct illumination of the illumination source in response to user input and/or as part of performing various other operations. The duty cycle may define a first portion of time that power is provided to the illumination source from the battery 104 and a second portion of time that power is not provided to the illumination source from the battery. The processing unit may vary the duty cycle (i.e., the combination of the first and second portions of the period of time) between the first and second portions such that the illumination source is perceived (such as by one or more users and/or illumination receiver elements) to be consistently illuminated despite the second portions of the duty cycle.

Figure 2A:
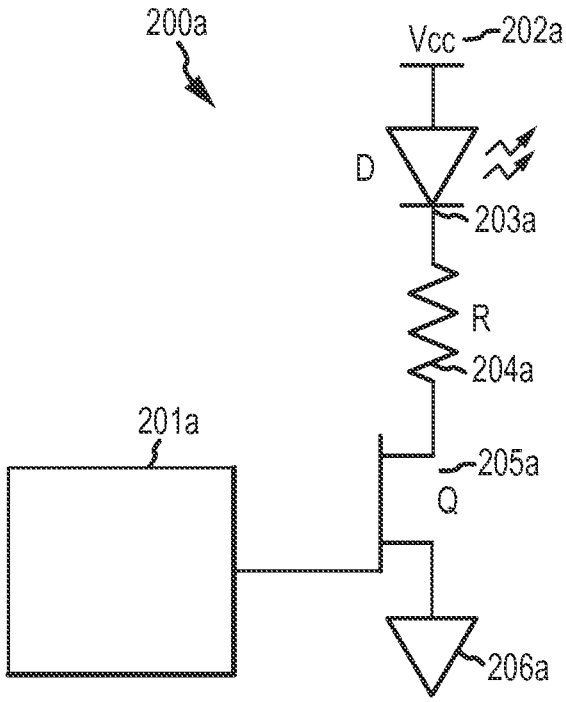
FIG. 2A is a circuit diagram illustrating a first example of direction of illumination of an illumination source by a processing unit.

FIG. 2A illustrates a first example 200A of direction of illumination of an illumination source 203*a* by a processing unit 201*a*. As illustrated, the example 200A illustrates an example of a low side switching circuit. As also illustrated, a LED 203*a* (though in other implementations the LED 203*a* may be any kind of illumination element) that is connected to a voltage source 202*a*. The LED 203*a* is also configured to be connected to a ground 206*a* via a resistor 204*a* (though in other implementations more than one resistor may be included and/or no resistors may be included) and a transistor 205*a* (which is illustrated as a field-effect transistor though in other implementations switching elements may be utilized such as one or more bipolar junction transistors) that is controlled by a processing unit 201*a*. By controlling the transistor 205*a*, the processing unit 201*a* is able to connect the LED 203*a* to the ground 206*a* (causing power to flow through the LED 203*a*, illuminating the LED 203*a*) and/or disconnect the LED 203*a* from the ground 206*a* (causing power to not flow through the LED 203*a*). As such, the processing unit 201*a* is able to direct illumination of the LED 203*a*. The LED 203*a* may be the illumination source 103 of FIG. 1 and the processing unit 201*a* may be the processing unit 102 of FIG. 1.

Figure 2B:
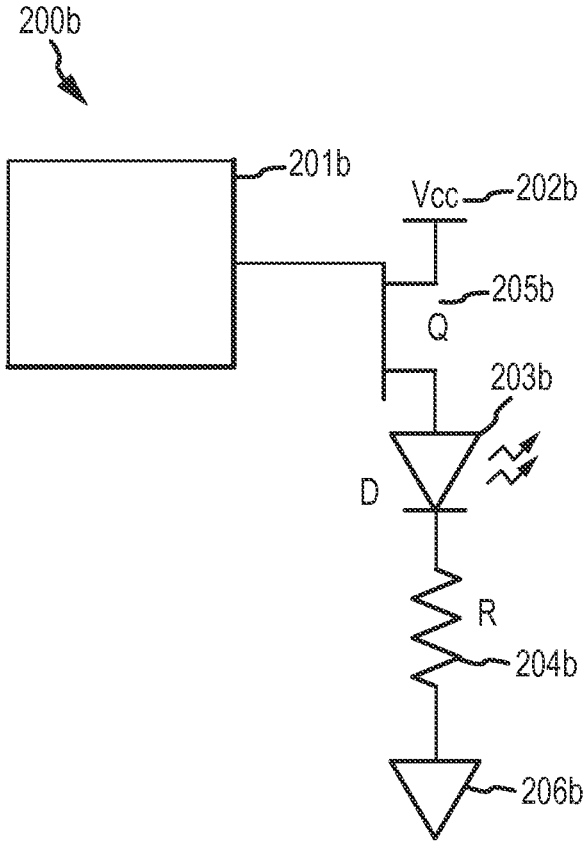
FIG. 2B is a circuit diagram illustrating a second example of direction of illumination of an illumination source by a processing unit.

FIG. 2B is a circuit diagram illustrating a second example of direction of illumination of an illumination source by a processing unit. As illustrated, the example 200B illustrates an example of a high side switching circuit. As also illustrated, a LED 203*b* (though in other implementations the LED 203*b* may be any kind of illumination element) that is connected to a ground 206*b* via a resistor 204*b* (though in other implementations more than one resistor may be included and/or no resistors may be included). The LED 203*b* is also configured to be connected to a voltage source 202*b* via a transistor 205*b* (which is illustrated as a field-effect transistor though in other implementations switching elements may be utilized such as one or more bipolar junction transistors) that is controlled by a processing unit 201*b*. By controlling the transistor 205*b*, the processing unit 201*b* is able to connect the LED 203*b* to the current source 202*b* (causing power to flow through the LED 203*b*, illuminating the LED 203*b*) and/or disconnect the LED 203*b* from the current source 202*b* (causing power to not flow through the LED 203*b*). As such, the processing unit 201*b* is able to direct illumination of the LED 203*b*. The LED 203*b* may be the illumination source 103 of FIG. 1 and the processing unit 201*b* may be the processing unit 102 of FIG. 1.

Although FIGS. 2A and 2B illustrated example implementations of how the processing unit 102 may direct the illumination element 103 to illuminate, it is understood that these are for the purposes of example. Other implementations may utilize different arrangements of different components in different ways without departing from the scope of the present disclosure. Additionally, the concepts illustrated in FIGS. 2A and 2B may be combined to allow the processing unit 102 of FIG. 1 to control the illumination of more illumination sources than the number of control pins available on the processing unit.

Returning to FIG. 1, the processing unit 102 may monitor voltage output by the battery 104 utilizing the analog to digital converter 105. The processing unit may compare the monitored voltage with a maximum voltage level of the battery (which may be the voltage that is output by the battery when the battery is at full capacity). The processing unit may adjust the duty cycle to increase the duration of the first portion of time (and correspondingly decrease the duration of the second portion of the time) based at least on a decrease of the monitored voltage compared to the maximum voltage level. In this way, as the voltage output by the battery decreases corresponding to the depletion of the battery's capacity, the first portion of time of the duty cycle may be increased and a consistent illumination output level output by the illumination source 103 may be maintained.

For example, at full capacity the battery 104 may output 3.2 volts. Thus, the maximum voltage level may be 3.2 volts. When the monitored voltage is 3.2 volts, the processing unit 102 may set the duty cycle such that the first period (or the "on" portion of the duty cycle) is 10% of a unit of time (such as five seconds) and the second period (or the "off" portion of the duty cycle) is the remaining 90% of the unit of time. However, at a diminished capacity, the battery may only output 1.8 volts. When the monitored voltage is 1.8 volts, the processing unit 102 may adjust the duty cycle such that the first period is 30% of the unit of time and the second period is the remaining 70% of the unit of time. As such, a consistent illumination output level output by the illumination source 103 may be maintained.

Figure 3:
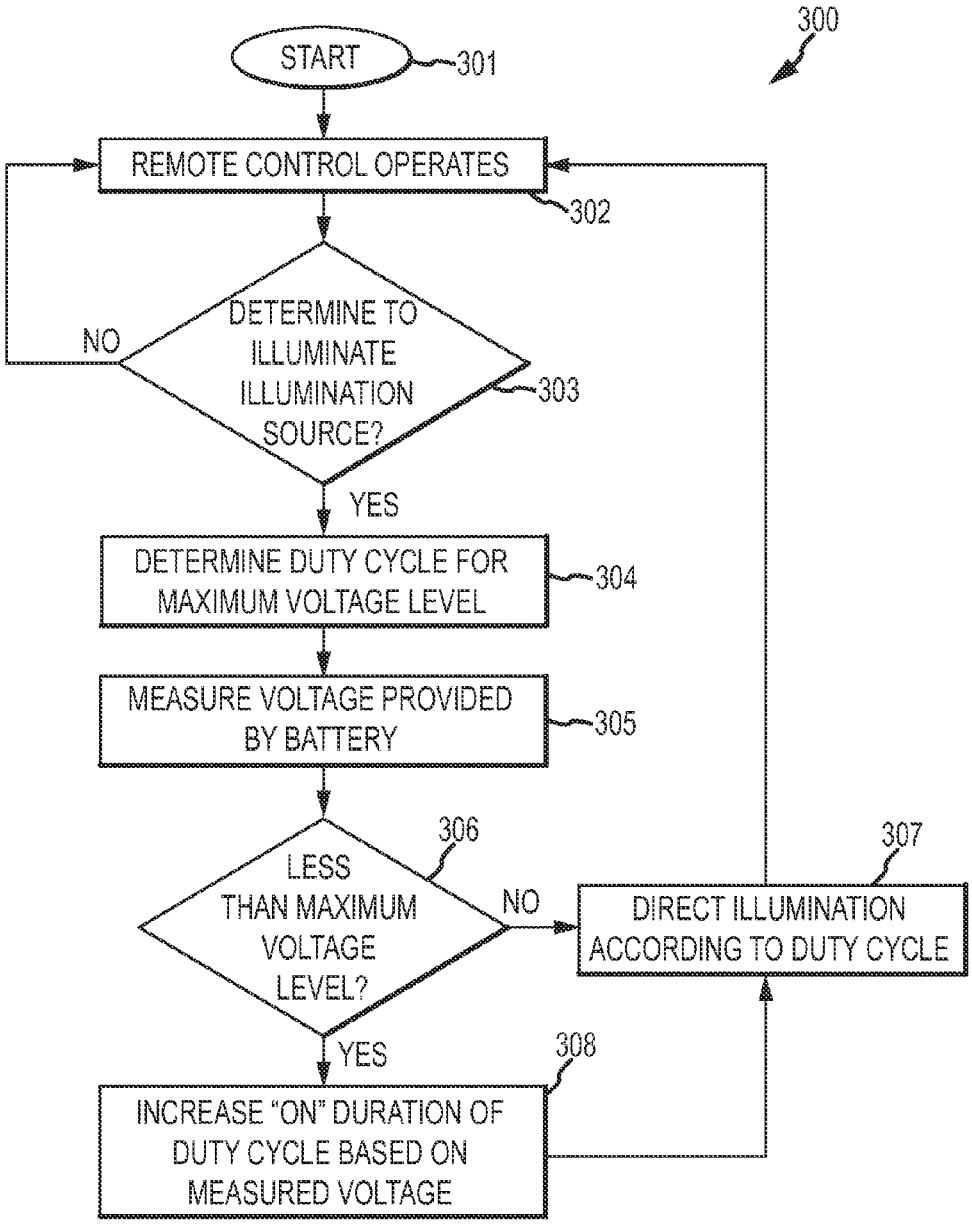
FIG. 3 is a flow chart illustrating a method for adjusting duty cycles of remote control illumination sources. This method may be performed by the system of FIG. 1.

FIG. 3 illustrates a method 300 for adjusting duty cycles of remote control illumination sources. The method 300 may be performed by the remote control device 101 of FIG. 1. The flow begins at block 301 and proceeds to block 302 where the remote control device 101 operates. The flow then proceeds to block 303 where the processing unit 102 determines whether or not to direct the illumination source 103 to illuminate. The processing unit may direct illumination of the illumination source in response to user input and/or as part of performing various other operations. If so, the flow proceeds to block 304. Otherwise, the flow returns to block 302 where the remote control device continues to operate.

At block 304, after the processing unit 102 determines to direct the illumination source 103 to illuminate, the processing unit may determine the duty cycle for the illumination element for the maximum voltage level of the batter 104. The flow then proceeds to block 305 where the processing unit may utilize the analog to digital converter 105 to measure the voltage provided by the battery. Next, the flow proceeds to block 306 where the processing unit determines whether or not the measured voltage is less than the maximum voltage level. If not, the flow proceeds to block 307 where the processing unit directs the illumination element to illuminate according to the duty cycle before the flow returns to block 302 where the remote control device continues to operate. Otherwise, the flow proceeds to block 308.

At block 308, after the processing unit 102 determines the measured voltage is less than the maximum voltage level, the processing unit increases the "on" portion of the duty cycle based at least on the measured voltage (and correspondingly decreases the "off" portion of the duty cycle). The flow then proceeds to block 307 where the processing unit directs the illumination element to illuminate according to the adjusted duty cycle before the flow returns to block 302 where the remote control device continues to operate.

Although the method 300 is illustrated and described above as including particular operations arranged in a particular order, other arrangements of other operations are possible without departing from the scope of the present disclosure. For example, the method 300 is illustrated as determining the duty cycle for the maximum voltage level of the battery 104, measuring the voltage output by the battery, and then adjusting the duty cycle accordingly. However, in other implementations the duty cycle may not be determined first for the maximum voltage level but may instead be set directly based on the measured voltage. In other implementations the duty cycle may be determined based upon the minimum expected voltage and with the duty cycle decreased for voltages above the minimum. Additionally the method 300 may be modified based upon additional information such as ambient operating conditions without departing from the scope of this disclosure.

Returning to FIG. 1, in some implementations, the processing unit may adjust the duty cycle based on one or more threshold values. For example, when the monitored voltage is within a threshold number of volts (such as 0.3 volts), the processing unit may set the duty cycle such that the first period of time is the same as if the monitored voltage is equivalent to the maximum voltage level. However, when the monitored voltage is not within the threshold number of volts, the processing unit may increase the duration of the first period of time of the duty cycle.

Further, though the above example utilizes a single threshold, multiple different threshold values may be utilized such that the duration of the first portion of the duty cycle is increased different amounts based on a "step value" (or voltage value interval) of the measured voltage. For example, when the monitored voltage is between 3.2 volts and 2.8 volts, the processing unit may set the duty cycle such that the first period is 10% of a unit of time is the remaining 90% of the unit of time. Further, when the monitored voltage is between 2.8 volts and 2.2 volts, the processing unit may set the duty cycle such that the first period is 20% of a unit of time is the remaining 80% of the unit of time. Additionally, when the monitored voltage is less than 2.2 volts, the processing unit may set the duty cycle such that the first period is 30% of a unit of time is the remaining 70% of the unit of time. In this way, as the voltage output by the battery decreases, the first portion of time of the duty cycle may be increased (and the second portion of the time of the duty cycle may be correspondingly decreased) and a consistent illumination output level output by the illumination source 103 may be maintained.

However, instead of utilizing step values, in other implementations the processing unit may adjust the duty cycle directly based on the measured voltage. As such, whenever the measured voltage decreases, the duration of the first portion of the duty cycle may increase (and the duration of the second portion of duty cycle may correspondingly decrease). For example, when a maximum voltage level output by the battery 104 is 3.2 volts and a significantly depleted battery 104 outputs only 1.8 volts, the processing unit may set the duration of the first period of the duty cycle as 10% of the duty cycle plus 20 multiplied by (3.2−monitored voltage)/1.4. As such, the first period may be 10% when the measured voltage is 3.2 volts, approximately 18.571% when the measured voltage is 2.6 volts, approximately 24.285% when the measured voltage is 2.2 volts, and so on. This may result in a relatively smooth increase in the duty cycle as the monitored voltage decreases as compared with approaches utilizing step values. In other implementations, the calculation may be based upon decreasing the duty cycle based upon how much the measured voltage is above the minimum expected voltage. However, in other examples of such implementations, the processing unit may utilize more and/or less complicated calculations in deriving the duty cycle based at least one the measured voltage and may thus obtain smoother or rougher increases in the duty cycle as the monitored voltage decreases.

In either of the two above implementations, as well as other implementations, the processing unit may utilize a lookup table (which may be stored in the non-transitory storage medium 106) to determine any possible duty cycle adjustment based on the measured voltage instead of actually calculating the duty cycle adjustment regardless of the approach utilized to calculate the duty cycle adjustment. Such a lookup table may include one or more entries that include correspondences between a particular measured voltage and a duty cycle adjustment. For example, an entry for 3.2 volts may correspond to a 10% duration for the first portion and an entry for 1.8 volts may correspond to a 30% duration for the first portion.

In the present disclosure, the methods disclosed may be implemented as sets of instructions or software readable by a device. Further, it is understood that the specific order or hierarchy of steps in the methods disclosed are examples of sample approaches. In other embodiments, the specific order or hierarchy of steps in the method can be rearranged while remaining within the disclosed subject matter. The accompanying method claims present elements of the various steps in a sample order, and are not necessarily meant to be limited to the specific order or hierarchy presented.

The described disclosure may be provided as a computer program product, or software, that may include a non-transitory machine-readable medium having stored thereon instructions, which may be used to program a computer system (or other electronic devices) to perform a process according to the present disclosure. A non-transitory machine-readable medium includes any mechanism for storing information in a form (e.g., software, processing application) readable by a machine (e.g., a computer). The non-transitory machine-readable medium may take the form of, but is not limited to, a magnetic storage medium (e.g., floppy diskette, video cassette, and so on); optical storage medium (e.g., CD-ROM); magneto-optical storage medium; read only memory (ROM); random access memory (RAM); erasable programmable memory (e.g., EPROM and EEPROM); flash memory; and so on.

It is believed that the present disclosure and many of its attendant advantages will be understood by the foregoing description, and it will be apparent that various changes may be made in the form, construction and arrangement of the components without departing from the disclosed subject matter or without sacrificing all of its material advantages. The form described is merely explanatory, and it is the intention of the following claims to encompass and include such changes.

While the present disclosure has been described with reference to various embodiments, it will be understood that these embodiments are illustrative and that the scope of the disclosure is not limited to them. Many variations, modifications, additions, and improvements are possible. More generally, embodiments in accordance with the present disclosure have been described in the context or particular embodiments. Functionality may be separated or combined in blocks differently in various embodiments of the disclosure or described with different terminology. These and other variations, modifications, additions, and improvements may fall within the scope of the disclosure as defined in the claims that follow.

The invention claimed is:

1. A method for adjusting duty cycles of remote control illumination sources, the method comprising:

directing, utilizing at least one processing unit, illumination of at least one illumination source of a remote control device according to at least one duty cycle wherein the at least one duty cycle defines a first portion of time that power is provided to the at least one illumination source from at least one battery and a second portion of time that power is not provided to the at least one illumination source from the at least one battery;

monitoring, utilizing the at least one processing unit, at least one voltage output by the at least one battery that provides the power to the at least one illumination source; and adjusting the duty cycle based at least on the monitored at least one voltage, utilizing the at least one processing unit, to increase a duration of the first portion of time based at least on a decrease of the monitored at least one voltage compared to a maximum voltage level.

2. The method of claim 1, wherein said operation of adjusting the duty cycle based at least on the monitored at least one voltage, utilizing the at least one processing unit, to increase a duration of the first portion of time based at least on a decrease of the monitored at least one voltage compared to a maximum voltage level further comprises adjusting the duty cycle based on the monitored at least one voltage to increase the duration of the first portion of time based at least on the decrease of the monitored at least one voltage compared to the maximum voltage level such that a consistent illumination output level is maintained.

3. The method of claim 1, wherein said operation of adjusting the duty cycle based at least on the monitored at least one voltage, utilizing the at least one processing unit, to increase a duration of the first portion of time based at least on a decrease of the monitored at least one voltage compared to a maximum voltage level further comprises:

setting the duration of the first portion of time as a first duration when the maximum voltage level exceeds the monitored at least one voltage by less than a threshold value; and setting the duration of the first portion of time as a second duration when the maximum voltage level exceeds the monitored at least one voltage by at least the threshold value wherein the second duration is longer than the first duration.

4. The method of claim 3, further comprising setting the duration of the first portion of time as a third duration when the maximum voltage level exceeds the monitored at least one voltage by at least an additional threshold value wherein the third duration is longer than the second duration and the additional threshold value is greater than the threshold value.

5. The method of claim 1, wherein said operation of adjusting the duty cycle based at least on the monitored at least one voltage, utilizing the at least one processing unit, to increase a duration of the first portion of time based at least on a decrease of the monitored at least one voltage compared to a maximum voltage level further comprises increasing the duration of the first portion of time when the monitored at least one voltage decreases.

6. The method of claim 1, wherein the at least one illumination source comprises at least one of at least one illumination transmitter or at least one lighting element.

7. The method of claim 1, wherein the at least one illumination source comprises at least one of at least one light emitting diode, at least one infrared light emitting diode, at least one organic light emitting diode, at least one incandescent bulb, or at least one fluorescent bulb.

8. The method of claim 1, wherein said operation of adjusting the duty cycle based at least on the monitored at least one voltage, utilizing the at least one processing unit, to increase a duration of the first portion of time based at least on a decrease of the monitored at least one voltage from a compared to a maximum voltage level further comprises setting the duration of the first portion to a lookup duration value obtained from at least one lookup table based at least on the monitored at least one voltage.

9. The method of claim 8, wherein the at least one lookup table comprises a plurality of lookup voltages and corresponding duration values.

10. The method of claim 1, wherein said operation of monitoring, utilizing the at least one processing unit, at least one voltage output by the at least one battery further comprises monitoring the at least one voltage output by the at least one battery utilizing at least one analog to digital converter.

11. A system for adjusting duty cycles of remote control illumination sources, comprising:

a remote control device, comprising:

at least one at least one illumination source;

at least one battery that provides at least one voltage output; and at least one processing unit that directs illumination of the at least one illumination source according to at least one duty cycle wherein the at least one duty cycle defines a first portion of time that power is provided to the at least one illumination source from the at least one battery and a second portion of time that power is not provided to the at least one illumination source from the at least one battery;

wherein the at least one processing unit monitors the at least one voltage and adjusts the duty cycle based at least on the monitored at least one voltage to increase a duration of the first portion of time based at least on a decrease of the monitored at least one voltage compared to a maximum voltage level.

12. The system of claim 11, wherein the at least one processing unit adjusts the duty cycle based at least on the monitored at least one voltage by increasing the duration of the first portion of time when the monitored at least one voltage decreases.

13. The system of claim 11, wherein the at least one processing unit adjusts the duty cycle based at least on the monitored at least one voltage by setting the duration of the first portion to a lookup duration value obtained from at least one lookup table based at least on the monitored at least one voltage.

14. The system of claim 13, wherein the at least one lookup table is stored in at least one non-transitory storage medium and comprises a plurality of lookup duration values and corresponding voltages.

15. The system of claim 11, wherein the at least one processing unit adjusts the duty cycle based at least on the monitored at least one voltage by:

setting the duration of the first portion of time as a first duration when the maximum voltage level exceeds the monitored at least one voltage by less than a threshold value; and setting the duration of the first portion of time as a second duration when the maximum voltage level exceeds the monitored at least one voltage by at least the threshold value wherein the second duration is longer than the first duration.

16. The system of claim 15, wherein the at least one processing unit further adjusts the duty cycle based at least on the monitored at least one voltage by setting the duration of the first portion of time as a third duration when the maximum voltage level exceeds the monitored at least one voltage by at least an additional threshold value wherein the third duration is longer than the second duration and the additional threshold value is greater than the threshold value.

17. The system of claim 11, further comprising at least one analog to digital converter wherein the at least one processing unit monitors the at least one voltage output by the at least one battery utilizing the at least one analog to digital converter.

18. The system of claim 11, wherein the at least one processing unit adjusts the duty cycle based at least on the monitored at least one voltage to increase the duration of the first portion of time based at least on the decrease of the monitored at least one voltage compared to the maximum voltage level such that a consistent illumination output level is maintained.

19. The system of claim 11, wherein the at least one illumination source comprises at least one of at least one illumination transmitter or at least one lighting element.

20. The system of claim 11, wherein the at least one illumination source comprises at least one of at least one light emitting diode, at least one infrared light emitting diode, at least one organic light emitting diode, at least one incandescent bulb, or at least one fluorescent bulb.

* * * * *

UNITED STATES PATENT AND TRADEMARK OFFICE

CERTIFICATE OF CORRECTION

PATENT NO. : 8,710,771 B2
APPLICATION NO. : 13/288788
DATED : April 29, 2014
INVENTOR(S) : William R. Reams It is certified that error appears in the above-identified patent and that said Letters Patent is hereby corrected as shown below:

In the Claims

Claim 1, Column 9, Line 32:
"at least one at least one illumination source;" should read, --at least one illumination source;--.

Signed and Sealed this
Twenty-third Day of September, 2014

Michelle K. Lee

Michelle K. Lee
*Deputy Director of the United States Patent and Trademark Office*